US007520491B1

(12) United States Patent
Post

(10) Patent No.: US 7,520,491 B1
(45) Date of Patent: Apr. 21, 2009

(54) CLIP BENDER

(76) Inventor: Raymond Post, 15 Wagon Hammer La., Lander, WY (US) 82520

( * ) Notice: Subject to any disclaimer, the term of this patent is extended or adjusted under 35 U.S.C. 154(b) by 0 days.

(21) Appl. No.: 11/443,749

(22) Filed: May 30, 2006

Related U.S. Application Data

(60) Provisional application No. 60/685,177, filed on May 27, 2005.

(51) Int. Cl.
*E04H 17/02* (2006.01)

(52) U.S. Cl. ..... 256/57; 256/1

(58) Field of Classification Search ..... 81/450, 81/177.8, 177.6; 7/117; 256/1, 47–58, DIG. 3; 403/92–96
See application file for complete search history.

(56) References Cited

U.S. PATENT DOCUMENTS 1,473,436 A * 11/1923 Leopold ..... 81/177.8
2,921,773 A * 1/1960 Hoelzer ..... 81/177.8
5,526,723 A * 6/1996 Sormunen et al. ..... 81/450
5,909,910 A 6/1999 Shaffer
6,499,514 B1 12/2002 Hodge, Sr.
7,047,846 B1 * 5/2006 Hu ..... 81/177.8
2005/0274234 A1 * 12/2005 Lee ..... 81/177.8

* cited by examiner

*Primary Examiner*—Victor MacArthur
(74) *Attorney, Agent, or Firm*—Vidal A. Oaxaca; Justin R. Jackson; Peacock Myers, P.C.

(57) ABSTRACT

A fencing tool for bending wire clips used to secure fencing material to fence posts. The tool has a handle and a bit pivotally attached to the handle. The bit is inserted into a looped end of a wire clip and rotated about a fence wire to secure the clip to the fence wire and the fence wire to the fence post. A hole in the bit is provided within which to insert a non-looped end of a wire clip to likewise bend the wire clip around the fence wire as the bit is rotated about the fence wire.

7 Claims, 6 Drawing Sheets

CLIP BENDER

CROSS-REFERENCES TO RELATED APPLICATIONS

This application claims the benefit of the filing of U.S. Provisional Patent Application Ser. No. 60/685,177, titled "Clip Bender", filed May 27, 2005, and the specification in that application is incorporated herein by reference.

BACKGROUND OF THE INVENTION

1. Field of the Invention (Technical Field)

The present invention relates to a fencing tool, particularly a tool for securing fence wire to a fence post by bending a fencing wire clip.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Wire clips for securing fence wire to fence posts are secured into position by twisting or bending the clip around the fence wire. For example, T-posts are commonly used in agricultural settings, and fence wire is secured to the T-post by looping a commonly available T-post fencing clip (shown in FIG. 1) behind the T-post opposite the fence wire. Typically, pliers are used to grasp the ends of the clip and rotate the clip around the fence wire, but pliers are cumbersome, particularly when gloves are used. Another typical device used for bending clips is a rod, such as a screwdriver. When using a rod, the clip is bent by inserting the tool through a loop in one end of the clip and rotating the tool. Rods and pliers are also difficult to use because the user must reach behind the fence wire to rotate the tool as needed. Also, rotating such tools behind the fence wire material is often hindered because there is limited spacing between fence wires to allow full rotation of the tool.

Some prior art devices that have been developed to improve the securing of wire clips include the bar described in U.S. Pat. No. 5,909,910. The bar comprises two teeth at an end within which to insert an end of the T-post clip. Like other bars, its rotation can be limited by the spacing between fence wires. Another approach is the tool and pre-formed clip combination described in U.S. Pat. No. 6,499,514. The tool comprises a handle with two prongs that are inserted in the two looped ends of the clip. The tool is not used with the typical T-post clips that are commercially available and is designed for use with the specifically designed clip of the invention.

The present invention is used with typical, commercially available clips and overcomes the problems described above.

BRIEF SUMMARY OF THE INVENTION

The present invention provides a wire clip bending tool. An embodiment of the present invention comprises a wire clip bending tool for securing fencing material to a fence post, the tool comprising a handle, a bit pivotally attached to the handle for inserting into a looped end of a wire clip, and a hole disposed in the bit for receiving a non-looped end of the wire clip. Preferably, a longitudinal axis of the hole is oriented substantially parallel to an angle of rotation of the bit. The bit preferably comprises a groove. The tool preferably comprises at least three stops in the rotation of the bit. The tool may comprise a key and a spring to provide the stops.

Another embodiment of the present invention comprises a method for securing a fence wire to a fence post, said method comprising disposing a wire clip over the fence wire and around the fence post, providing a wire clip bending tool comprising a handle, a bit pivotally attached to the handle, and a hole disposed in the bit for receiving a non-looped end of the wire clip, inserting the bit into a looped end of the wire clip, and rotating the bit about the fence wire to secure the clip to the fence wire and the fence wire to the post. The method may also comprise inserting the non-looped end of the wire clip into the hole and rotating the bit about the fence wire to secure the clip to the fence wire and the fence wire to the post.

A primary object of the present invention is to simplify the bending and securing of a wire clip to a fencing material and fence post.

Another object is to allow a user to bend a wire clip without reaching behind fencing wire to push and/or pull a bending tool.

A primary advantage of the present invention is that the present invention allows for the bending of wire clips about fencing wire material having limited spacing between the fencing wires.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention provides a tool for securing a wire clip about a fencing material, such as a fence wire, and post. Although the embodiments described herein relate to the securing of fence wire to T-posts, the present invention may be applied to other types of fencing material and posts as would be understood by a person of ordinary skill in the art. As used in the specification and claims herein, the terms "a", "an", and "the" mean one or more.

Figure 1:
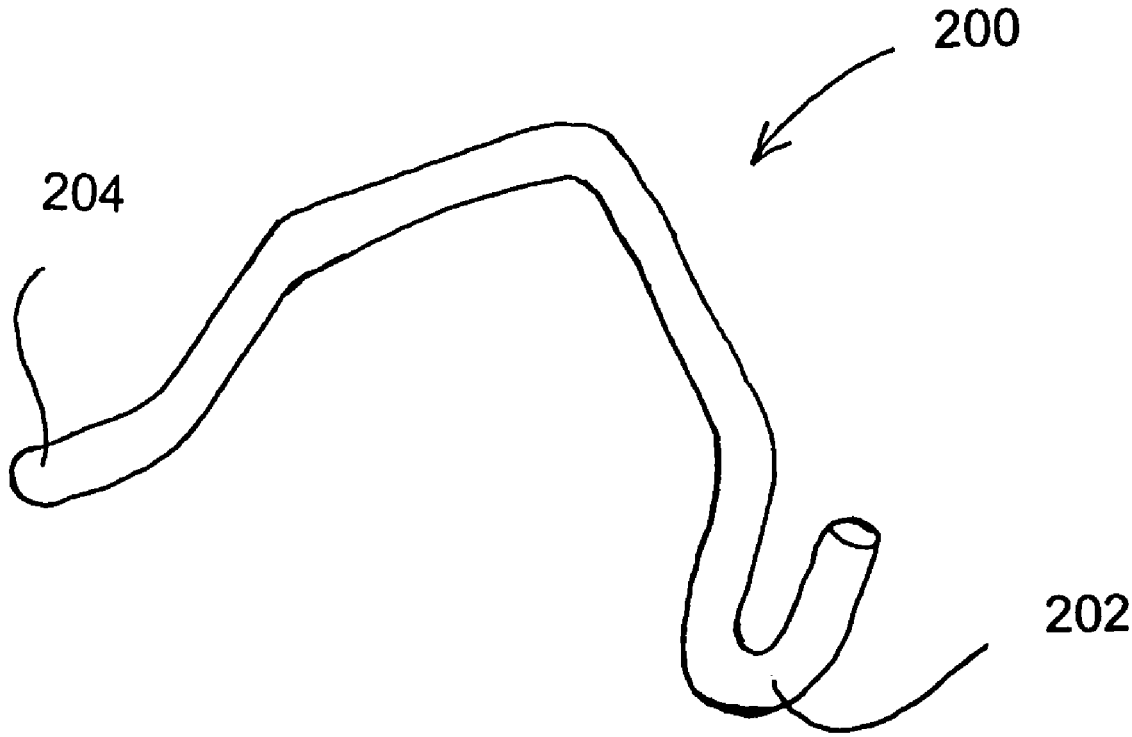
FIG. 1 (PRIOR ART)
FIG. 1 is a perspective view of a clip of the prior art.

FIG. 1 shows a wire clip typical in the art for securing fence wire to a T-post. Clip 200 comprises two ends, looped end 202 and non-looped end 204, which are twisted or bent around a fence wire.

Figure 2:
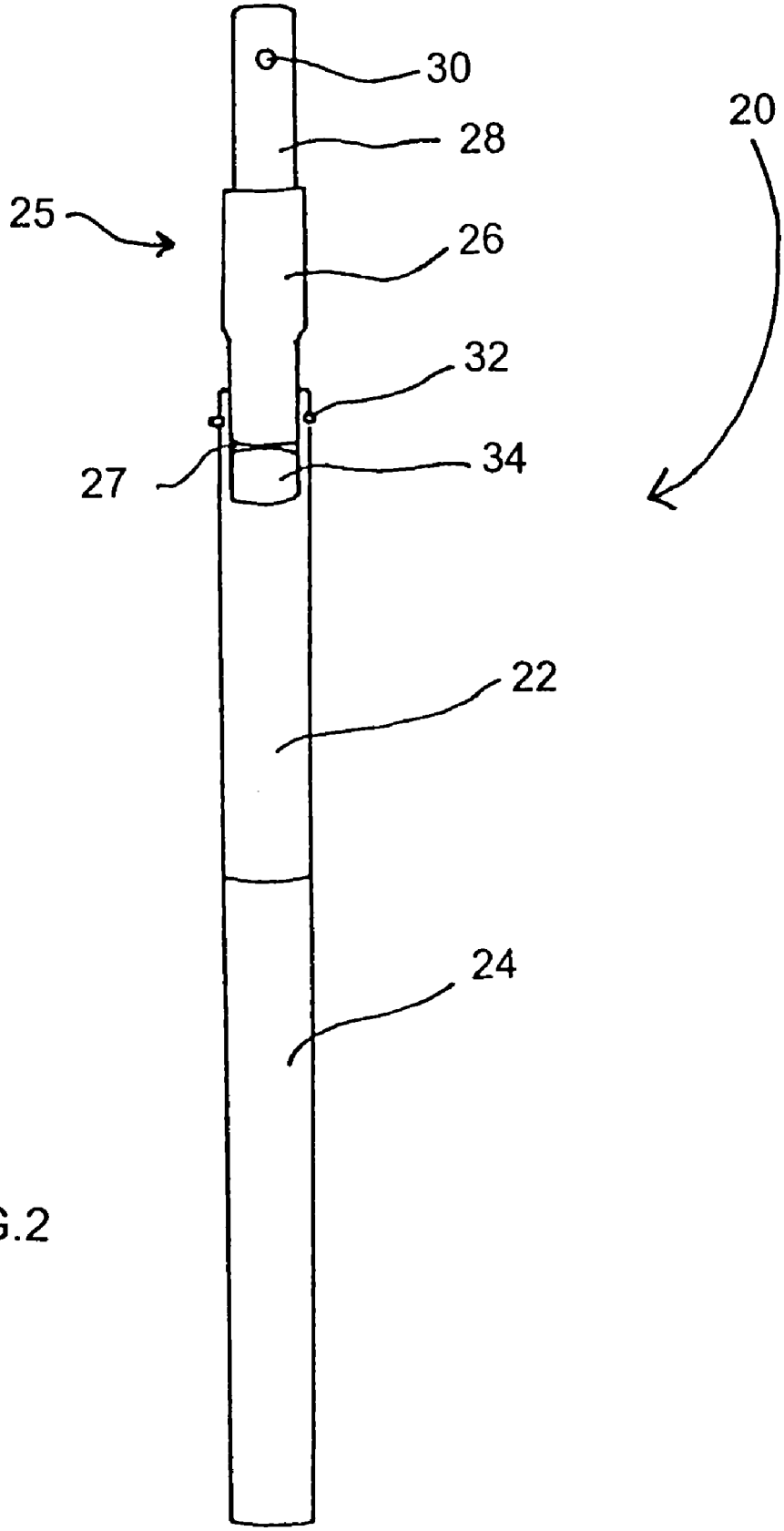
FIG. 2 is a side view of the preferred embodiment of the present invention.
Figure 3:
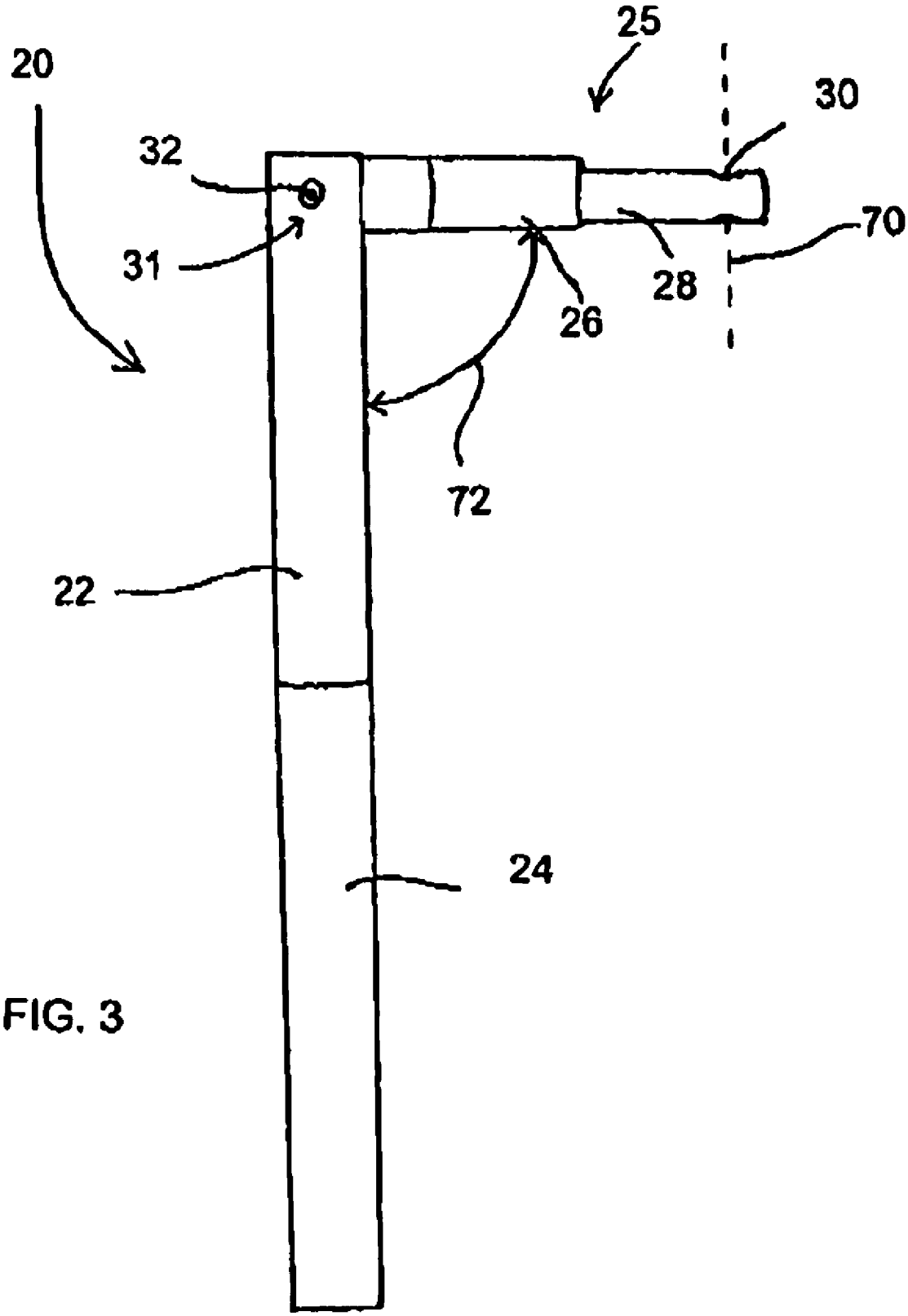
FIG. 3 is a side view of the embodiment of FIG. 1, rotated 90° from the view shown in FIG. 1, with the bit pivoted about the handle.

FIG. 2 shows an embodiment of the present invention comprising tool 20 for bending ends 202 and 204 of clip 200. Tool 20 comprises handle 22 attached to bit 25. Both handle 22 and bit 25 are essentially rods having any axial cross section or variety of cross sections although they are shown herein as having round cross sections. Bit 25 is pivotally attached to handle 22 with roll pin 32 so that bit 25 swivels about pivot point 31 via roll pin 32 as shown in FIG. 3. Although roll pin 32 is used to secure bit 25 to handle 22, any fastener or means for pivotally attaching bit 25 to handle 22 may be utilized such as, but not limited to, a dowel, a pin, etc. To provide for adequate leverage, the length of bit 25 is preferably between 25% and 100% the length of handle 22, although any relative lengths may be utilized as may be readily ascertainable by one of ordinary skill in the art.

Figure 4:
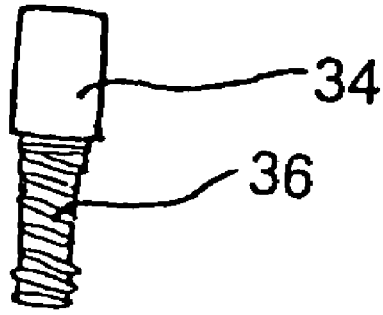
FIG. 4 is a side view of key and spring of the embodiment of FIG. 1.

In the embodiment shown in FIGS. 2 and 3, handle 22 comprises a gripping portion 24. Gripping portion 24 provides a user with better grip, thus any non-slip material known in the art may be utilized such as, but not limited to, rubber. Handle 22 also comprises a bore (not shown) at the end to which bit 25 attaches. The bore is oriented along the longitudinal axis of handle 22 with dimensions suitable for receiving key 34 (shown in FIGS. 2 and 4) and spring 36 (shown in FIG. 4). Key 34 and spring 36 provide for stops to securing bit 25 in at least three positions as bit 25 swivels. Handle 22 further comprises notch 27 to allow bit 25 to swivel unrestrained.

In the embodiment shown in FIGS. 2 and 3, bit 25 comprises thicker portion 26 and thinner portion 28 (i.e., a stepped profile), although in other embodiments, bit 25 can have a uniform dimensions throughout its length, or any variety of dimensions. The stepped profile of bit 25 provides for a more secure positioning of bit 25 into looped end 202 of wire clip 200. Bit 25 comprises hole 30 at one end through which non-looped end 202 of clip 200 is inserted during use. Hole 30 is preferably oriented so that its longitudinal axis 70 it is at substantially parallel to the angle of rotation 72 of bit 25 about pivot point 31. The opposite end comprises an attachment hole (not shown in FIGS. 2 and 3, but corresponding to attachment hole 46 of bit 40 of the embodiment shown in FIG. 5) through which roll pin 32 is inserted to secure bit 25 to handle 22.

Figure 5:
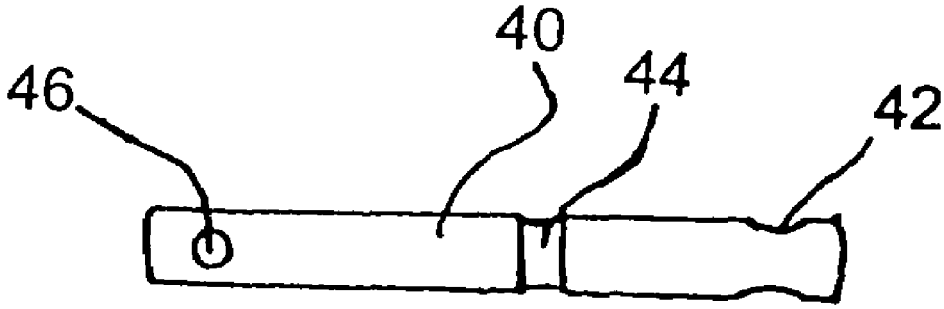
FIG. 5 shows another embodiment of the bit of the present invention.

In the embodiment of FIG. 5, bit 40 is used and attached to handle 22. Bit 40 is of uniform diameter except for circumferential groove 44 disposed between the two ends of bit 40. Groove 44 provides for a more secure positioning of bit 40 into looped end 202 of clip 200. Bit 40 further comprises hole 46 for inserting roll pin 32 for attachment to handle 22 and hole 42 for inserting non-looped end 204 of a clip 200.

Figure 6:
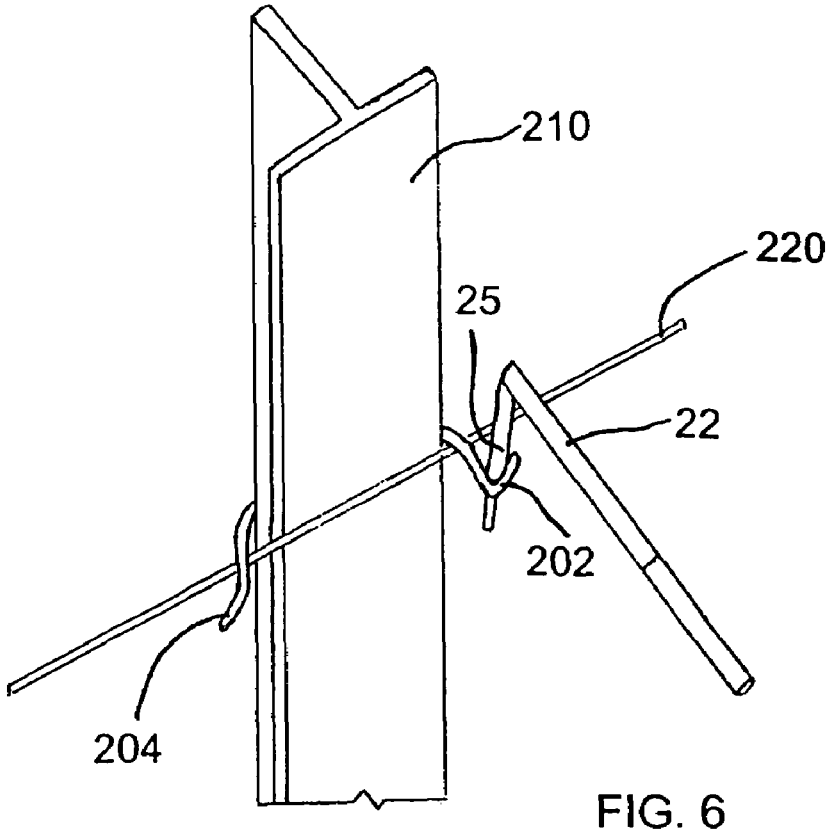
FIG. 6 is a perspective view of an embodiment of the tool of the present invention showing the invention in an initial position for securing a looped end of a clip to a post and a fence wire.
Figure 7:
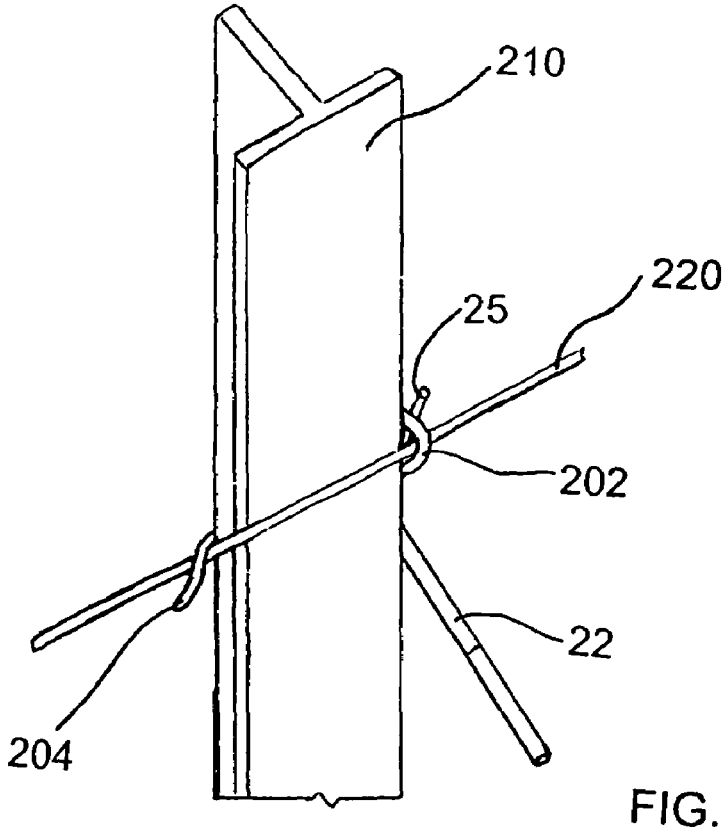
FIG. 7 is a perspective view of the embodiment shown in FIG. 6 with the tool in a position after rotation of the looped end of the clip.

As shown in FIG. 6, bit 25 (or bit 20) is inserted between looped end 202 of a fence clip 200 (which is wrapped around T-post 210) and set against and below fence wire 220. Tool 20 is then moved downward, followed by a pushing motion. As tool 20 is moved downward then pushed forward, bit 22 swivels to bend clip 200 around fence wire 220 as shown in FIG. 7. In other words, the bit twists the clip as the bit is rotated about the fence wire.

Figure 8:
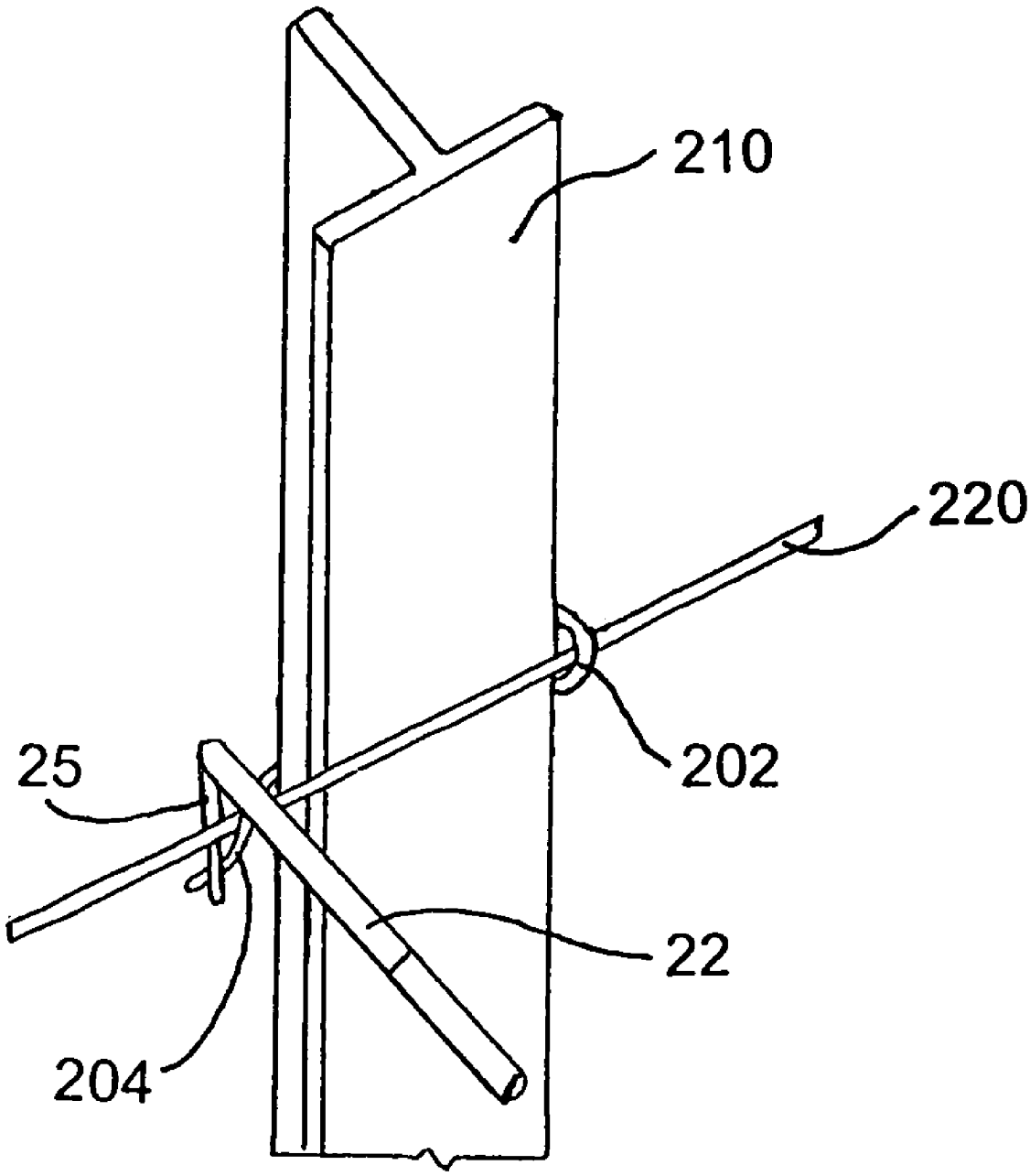
FIG. 8 is a perspective view of the embodiment shown in FIGS. 6 and 7 with the tool in an initial position for securing the non-looped end of the clip.

As shown in FIG. 8, non-looped end 204 of clip 200 is inserted into hole 30 of bit 25 (or hole 42 of bit 40) and set against and above fence wire 220. Tool 20 is then pulled in a downward motion to bend clip 200 around fence wire 220 thus securing fence wire 220 to the T-post 210. As with the opposite, looped end of the clip, the bit twists the clip as the bit is rotated about the fence wire.

All components of the present invention comprise a rigid material such as, but not limited to, metal, preferably steel. Being a hand tool, tool 20 is of any dimensions suitable for manipulation with one hand.

EXAMPLE

A tool in accordance with the present invention is constructed as follows:

1. The handle measures approximately 7/16"×6½", with a rubberized portion along the bottom, approximately 4", of the handle.
2. The handle is bored at one end, the bore measuring approximately ¼"×1¼" deep.
3. The handle comprises a notch milled at the top, approximately ¼" wide×½" deep.
4. The handle comprises an approximately ⅛" diameter hole drilled at the top through which an approximately ⅛"×½" in diameter roll pin is inserted, and which is also inserted through the bit described below to secure the bit to the handle. In another embodiment, the hole is approximately 9/64" in diameter.
5. An approximately ¼"×½" spring disposed on an approximately ¼"×⅜" key is disposed, along with the spring, within the bore of the handle.
6. The bit is approximately ⅜" in diameter on the half attached to the handle, and the other half measures approximately ¼" in diameter. The bit measures approximately 2½" in length. The bit comprises an approximately ⅛" diameter hole at the non-attachable end to accept a fence wire end.
7. Another bit is alternatively attached to the handle. The bit measures approximately ¼" in diameter throughout its length except that a groove is cut around the middle of the bit so that the diameter of the bit about the groove measures approximately 3/16". The bit comprises an approximately ⅛" diameter hole at the non-attachable end to accept a fence wire end.
8. Using either bit, the tool is used effectively to bend fence clips to secure fence wire to a fence post.

The preceding examples can be repeated with similar success by substituting the generically or specifically described components, mechanisms, materials, and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A tool and clip assembly for securing fencing material to a fence post, said assembly comprising:

a wire clip having a non-looped end;

a tool having a handle pivotally attached to a tool bit rod thereby defining an axis of rotation at a pivot point between said handle and said tool bit rod;

a first end of said rod pivotally attached to said pivot point, said rod extending from said first end to a second end of said rod that is distal from said handle and said pivot point;

an open hole disposed in said second end, said hole having a central longitudinal axis substantially perpendicular to said axis of rotation, said central longitudinal axis of said hole extending tangentially from a circular path of rotation of said bit about said pivot point; and whereby said open hole is operable to receive said non-looped end such that said tool may rotate about the fencing material to loop said non-looped end about the fencing material to clamp the post between said wire clip and the fencing material.

2. The tool and clip assembly of claim 1 further comprising a circumferential groove about a diameter of said rod.

3. The tool and clip assembly of claim 1 wherein said bit comprises a stepped profile about a diameter of said rod.

4. The tool and clip assembly of claim 1 further comprising at least three stops in the rotation of said bit.

5. The tool and clip assembly of claim 4 further comprising a key and a spring to provide said stops.

6. A method for securing a fence wire to a fence post, said method comprising:

Providing a tool and clip assembly, said assembly comprising:

a wire clip having a non-looped end;

a tool having a handle pivotally attached to a tool bit rod thereby defining an axis of rotation at a pivot point between said handle and said tool bit rod;

a first end of said rod pivotally attached to said pivot point, said rod extending from said first end to a second end of said rod that is distal from said handle and said pivot point;

an open hole disposed in said second end, said hole having a central longitudinal axis substantially perpendicular to said axis of rotation, said central longitudinal axis of said hole extending tangentially from a circular path of rotation of said bit about said pivot point; and inserting said bit into a looped end of said wire clip; and rotating said bit about the fence wire to secure said clip to the fence wire and the fence wire to the post.

7. The method of claim 6 further comprising:

inserting said non-looped end of said wire clip into said hole; and rotating said bit about the fence wire to secure said clip to the fence wire and the fence wire to the post.

* * * * *